US006534753B1

(12) United States Patent
Boyd et al.

(10) Patent No.: US 6,534,753 B1
(45) Date of Patent: Mar. 18, 2003

(54) BACKUP POWER SUPPLY CHARGED BY INDUCTION DRIVEN POWER SUPPLY FOR CIRCUITS ACCOMPANYING PORTABLE HEATED CONTAINER

(75) Inventors: Stephen B. Boyd, Merrimac, MA (US); Douglas A. Johnson, Groveland, MA (US)

(73) Assignee: Wilmington Research and Development Corporation, Newburyport, MA (US)

( * ) Notice: Subject to any disclaimer, the term of this patent is extended or adjusted under 35 U.S.C. 154(b) by 0 days.

(21) Appl. No.: 09/694,069

(22) Filed: Oct. 20, 2000

Related U.S. Application Data

(63) Continuation-in-part of application No. 09/678,723, filed on Oct. 4, 2000.

(60) Provisional application No. 60/211,562, filed on Jun. 15, 2000.

(51) Int. Cl.[7] ..... H05B 6/06

(52) U.S. Cl. ..... 219/663; 219/620; 219/627

(58) Field of Search ..... 219/663, 627, 219/626, 620–622, 624, 647, 650, 667, 660, 387, 528, 725; 99/DIG. 14

(56) References Cited

U.S. PATENT DOCUMENTS

| | | | | |
|---|---|---|---|---|
| 1,683,889 A | | 9/1928 | Hayne | |
| 3,721,803 A | | 3/1973 | DiStefano | 219/387 |
| 3,742,174 A | * | 6/1973 | Hamden, Jr. | 219/627 |
| 3,742,178 A | * | 6/1973 | Harnden, Jr. | 219/627 |
| 3,746,837 A | | 7/1973 | Frey et al. | 219/387 |
| 4,134,004 A | | 1/1979 | Anderson et al. | 219/387 |
| 4,816,646 A | | 3/1989 | Solomon et al. | 219/387 |
| 5,488,214 A | | 1/1996 | Fettig et al. | 219/127 |
| 5,611,327 A | * | 3/1997 | Filho et al. | 126/39 R |
| 5,711,988 A | * | 1/1998 | Tsai et al. | 427/80 |
| 5,750,962 A | | 5/1998 | Hyatt | 219/528 |
| 5,880,435 A | | 3/1999 | Bostic | 219/387 |
| 5,892,202 A | | 4/1999 | Baldwin et al. | 219/387 |
| 5,932,129 A | | 8/1999 | Hyatt | 219/528 |
| 5,954,984 A | | 9/1999 | Ablah et al. | 219/621 |
| 5,999,699 A | | 12/1999 | Hyatt | 392/339 |
| 6,018,143 A | | 1/2000 | Check | 219/387 |
| 6,060,696 A | | 5/2000 | Bostic | 219/387 |
| 6,062,040 A | | 5/2000 | Bostic et al. | 62/530 |
| 6,066,840 A | | 5/2000 | Baldwin et al. | 219/725 |
| 6,121,578 A | | 9/2000 | Owens et al. | 219/387 |
| 6,215,954 B1 | | 4/2001 | Hyatt | 392/339 |
| 6,232,585 B1 | * | 5/2001 | Clothier et al. | 219/620 |
| 6,274,856 B1 | | 8/2001 | Clothier et al. | 219/627 |
| 6,316,753 B2 | | 11/2001 | Clothier et al. | 219/621 |
| 6,320,169 B1 | | 11/2001 | Clothier | 219/626 |
| 6,350,972 B1 | * | 2/2002 | Wright et al. | 219/621 |
| 6,353,208 B1 | | 3/2002 | Bostic et al. | 219/387 |
| 6,384,387 B1 | | 5/2002 | Owens et al. | 219/601 |

FOREIGN PATENT DOCUMENTS

| | | |
|---|---|---|
| JP | 2238288 | 9/1990 |
| JP | 5326123 | 12/1993 |
| JP | 7114983 | 5/1995 |
| JP | 8306483 | 11/1996 |

OTHER PUBLICATIONS

"RWD Torque Measurement", *Teledyne Brown Engineering, Inc.* (3/00).

* cited by examiner

*Primary Examiner*—Teresa Walberg
*Assistant Examiner*—Quang T Van
(74) *Attorney, Agent, or Firm*—Hamilton, Brook, Smith & Reynolds, P.C.

(57) ABSTRACT

An induction heating system having an induction source, a heating element heated from the induction source, a power supply energized by the induction source and a circuit powered by the power supply. The circuit can be a controller which includes a temperature sensor for measuring a temperature of the heating element, and a feedback loop formed between the temperature sensor and the induction source. The heating element can be mounted within a housing to form an induction heated container for holding items to be heated. Such a container can be used in commercial food warming and holding.

35 Claims, 8 Drawing Sheets

BACKUP POWER SUPPLY CHARGED BY INDUCTION DRIVEN POWER SUPPLY FOR CIRCUITS ACCOMPANYING PORTABLE HEATED CONTAINER

RELATED APPLICATION(S)

This application is a Continuation-in-Part of U.S. application Ser. No. 09/678,723, filed Oct. 4, 2000, which claims the benefit of U.S. Provisional Application No. 60/211,562, filed Jun. 15, 2000, and the entire teachings of which are each incorporated herein by reference.

BACKGROUND OF THE INVENTION

Induction heating technology is well known and in wide spread use in industrial and commercial applications. One of the advantages of induction heating is the "non-contact" aspect of the technology. In particular, an induction heater uses magnetic fields to energize a heating element formed of a suitable radiation-sensitive material. The magnetic field generator need not be in contact with the heating element or even the item which is itself to be elevated in temperature. This arrangement makes induction heating a wise choice in applications where the heated item must easily be moved. These include industrial applications such as assembly lines or branding irons, as well as commercial food and plate warming.

There is a problem however with some of these applications. A plate warmer for example, needs to maintain the temperature of the plate below some defined allowable value. This is especially important if the plate is to be handled by a person, or if the plate is constructed of a plastic/metal composite.

One way to control the final temperature of the plate can be to apply the induction heating to the plate for a specific time duration. This method can provide poor results, unless the temperature of the plates was controlled before the start of the heating process. For example, if the same plate was exposed to an induction heater twice in a row, one time right after another, the plate can rise to a much higher temperature.

Another method of controlling the final temperature of the plate uses an external temperature sensor to measure the temperature of the plate before, and/or during the induction heating process. The sensor can be a "contact" or "non-contact" type. The "contact" type of temperature measurement spoils the inherent "non-contact" nature of the induction heating process. Additionally, it can be difficult to get the sensor to contact the correct surface of the heating element while providing a reliable, robust design. The "non-contact" type of temperature measurement is better, but more costly.

A completely different solution might involve a specially formulated metal heating element that only "couples" (i.e., allow currents to be induced) with the induction field if the temperature of the metal is below some pre-determined value. These metals have a Curie point that prevent the metal from overheating, even though the induction field is still present.

Other applications involve containers for take out food, such as pizza delivery bags, for example. These containers have typically been made with an external temperature indicator and a heating element heated by an AC source. These containers include an AC cord which can potentially entangle a user, creating safety issues when the container is transported.

The problem with the above methods is that none provide the capability of temperature indication, status monitoring, or other electronic functions after the heated item is removed from the induction heating device.

SUMMARY OF THE INVENTION

A solution to this problem is to place an induction-driven power supply within the electromagnetic field used to heat the heating element. The power supply can, for example, include an induction coil across which is induced a current. In an alternate embodiment, this can be provided by an opening or slot formed on the heating element, the opening having a first lead and a second lead, wherein the opening creates a voltage differential transferred to the first lead and the second lead.

The power supply is used to provide power to various electrical circuits which accompany the heating element. For example, these circuits may include a control system having a temperature sensor, a temperature indicator, and a communication link, such as an RF, light or sound link, which electronically controls the operation of induction source. The controller can communicate to the inductor, via the communication link, if more heating power is necessary and to indicate the desired temperature has been reached. The temperature indicator indicates when the element has reached an acceptable temperature and the unit is ready to be used.

Additionally, the circuits may include energy storage devices such as rechargeable batteries, or high capacity capacitors which are charged while the device is subjected to the electromagnetic field during the induction heating process. These energy storage devices permit the circuit to continue operating even when the container is removed from the electromagnetic field source.

In the case of the controller, the stored energy permits the monitoring of the temperature of the heating element with status LEDs even after the device has been removed from the inductor.

BRIEF DESCRIPTION OF THE DRAWINGS

The foregoing and other objects, features and advantages of the invention will be apparent from the following more particular description of preferred embodiments of the invention, as illustrated in the accompanying drawings in which like reference characters refer to the same parts throughout the different views. The drawings are not necessarily to scale, emphasis instead being placed upon illustrating the principles of the invention.

DETAILED DESCRIPTION OF THE INVENTION

Figure 1:
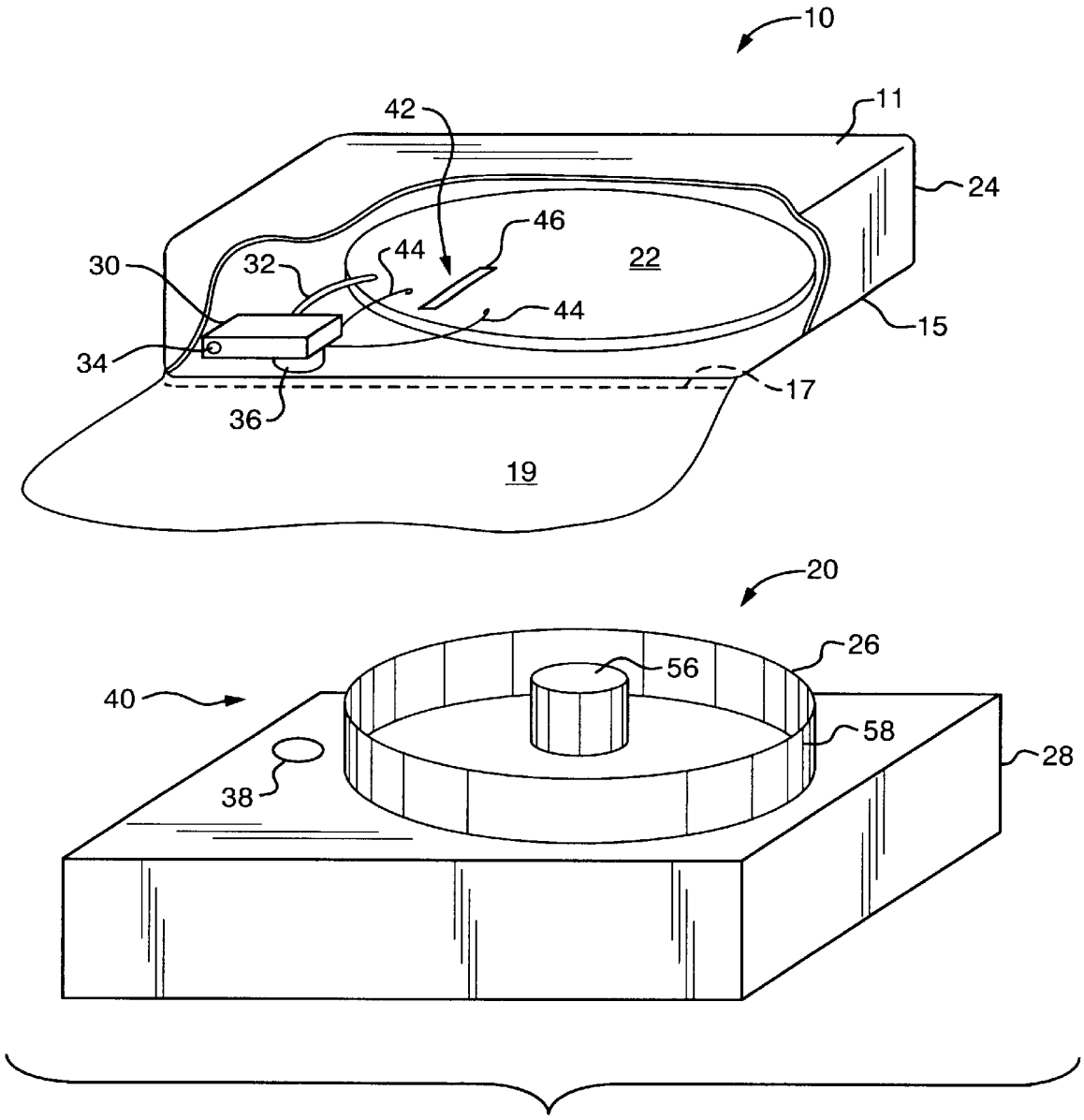
FIG. 1 illustrates an induction heating system comprising a power supply.

FIG. 1 illustrates an induction powered heating system, given generally as 10. The induction powered heating system 10 includes an induction source 20 and a heating element 22. The heating system 10 also includes a power supply 42 which is energized by the induction source 20. The heating element 22 can be formed of a material such that, when exposed to an induction source, a current is created within the heating element, thereby producing heat. The heating element 22 can be formed of a Curie point metal, for example. The heating element is typically mounted within a container or other housing 24 for the items to be heated (not shown).

The heating element 22 is mounted within a housing 24. The heating element 22 and housing 24 form an induction heated container for holding items to be heated. The housing 24 includes a cavity defined by a top surface 11, a bottom surface 15 and a side wall 19. The side wall 19 attaches to an outer edge 13 of the top surface 11 with an outer edge 17 of the bottom surface 15. A portion of the side wall 19 is moveably attached to the top surface 11 and the bottom surface 15 to allow user access to the cavity. The housing can be made of a thermally insulated material which can contain heat generated by the heating element 22. The illustrated housing is a bag for storage of food, such as a pizza bag, for example.

The induction source 20 includes a field generator 26 and a power supply 28. The field generator 26 has a core 56 and a ring 58, where the core 56 and the ring 58 are made from ferrite, for example. The field generator 26 creates a magnetic flux which is used to induce a current in the heating element 22, thereby creating heat. The power supply 28 can be a standard 120 VAC or a 240 VAC connection, for example.

The induction source 20 can produce an alternating magnetic flux. For example, at one instant, the core 56 can have a first polarity and the ring 58 can have a second polarity, thereby producing a radial magnetic field directed along the center axis of the core 56 and the ring 58. At another instant the polarities of the core 56 and the ring 58 can switch such that the core 56 has a second polarity while the ring 58 has a first polarity. The resulting alternating magnetic flux induces a current in the heating element 22 to produce heat, provided that the heating element 22 is placed in close enough proximity to the induction source 20.

The local power supply 42 is carried within the housing 24. It can be as simple as an opening 46 on the heating element 22, shown in FIG. 1, such as a slot 46 formed in the heating element 22, for example. Other geometries can also be used. Each side of the opening 46 can be coupled to leads 44, such as a first lead and a second lead, which, in turn, can be coupled to an electronic circuit. When the heating element 22 is exposed to the induction source 20, a current is created along the surfaces of the heating element 22. The opening 46 creates a voltage drop; the leads 44 are placed on either side of the opening 46 draw the AC voltage created by this voltage drop. The voltage thus created is then used to power an electronic circuit.

Figure 2:
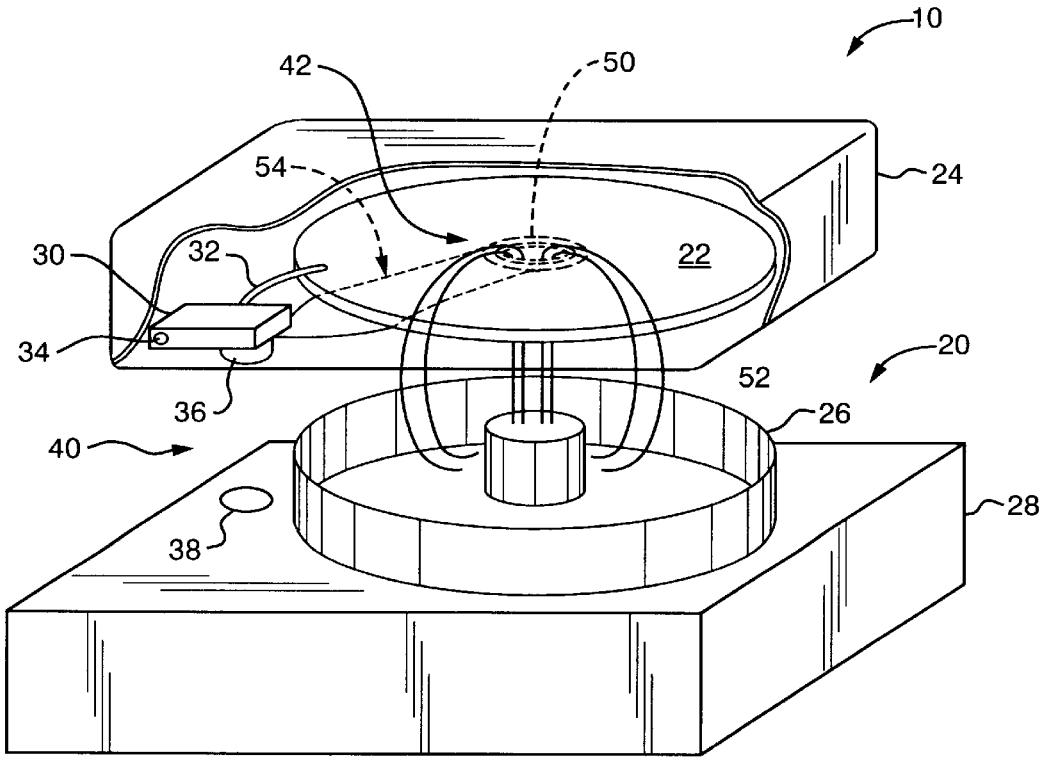
FIG. 2 illustrates an alternate embodiment of the heating system.
Figure 3:
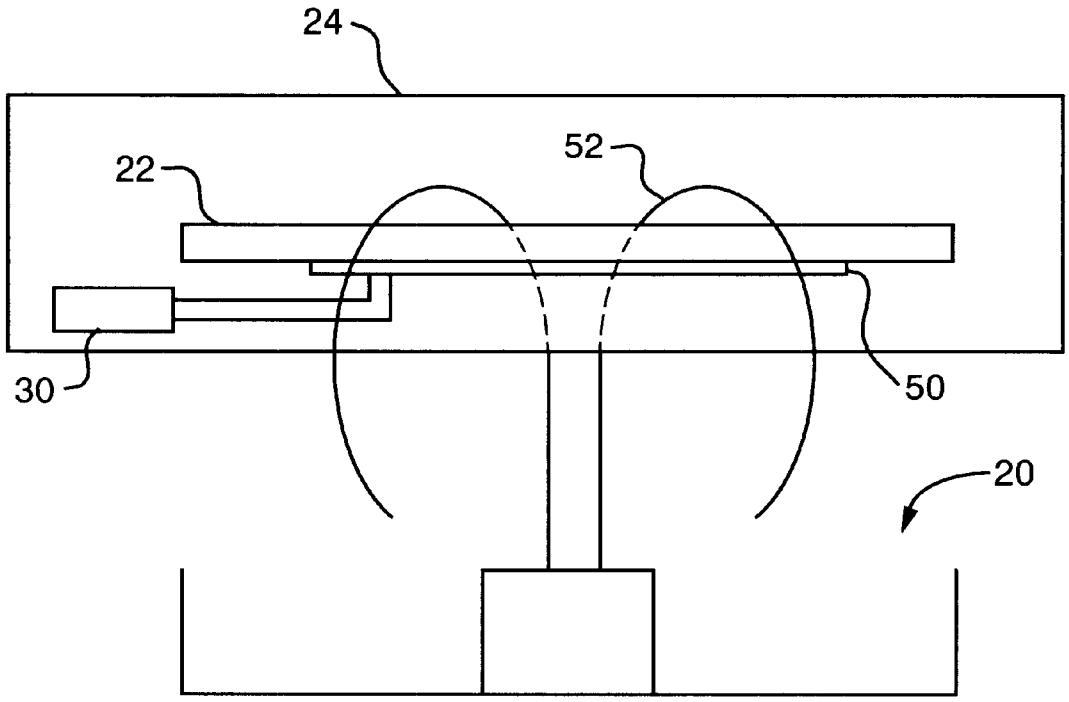
FIG. 3 illustrates a cross sectional view of a heating element housing where the heating element has a coil.

FIGS. 2 and 3 illustrate an alternate embodiment of power supply 42 as a wire coil 50. The coil 50 can be mounted in physical relationship within the container to be subjected to the magnetic field created by the induction source 20. The coil 50 can be formed integrally with the heating element 22. For example, the coil 50 can be etched or plated on to the heating element 22. Alternately, the coil can be physically separate from the heating element 22. Exposure of the coil 50 to a magnetic flux 52 created by the induction source 20 induces a current within the coil 50. The coil 50 includes coil leads 54 which connect to an electronic circuit and provide power from the current created in the coil 50 to the circuit. In the preferred embodiment, the coil 50 is placed in a plane of the heating element 22 nearest the induction source 20; otherwise the material of the element 22 might interfere with the coil 50 receiving sufficient energy.

As mentioned previously, the supply 42 provides power to a circuit located within the housing 24. The electronic circuit can be a heat control 30. The controller 30 can include a temperature sensor 32, which is arranged to measure the temperature of the heating element 22. The controller 30 can also include a temperature indicator 34 which can be a light emitting diode, for example. The temperature indicator 34 can be used to indicate that the interior of the housing 24 is at a temperature appropriate for maintaining the warmth of its contents.

The induction powered heating system 10 can also include a communication link 40. Preferably, the communication link 40 is an infrared link. The communication link 40, however, can be an ultrasound communication link or a radio communication link. The communication link 40 can include a transmitter 36 and a receiver 38. The transmitter 36 can be in electrical communication with the controller 30 and the receiver 38 can be in electrical communication with the induction source 20. The communication link 40 can help form a feedback loop between the temperature sensor 32 and the induction source 20. In this manner, when the heating element 22 is exposed to a magnetic flux created by the induction source 20, the temperature of the heating element 22 rises. The temperature sensor 32 then measures the temperature of the element 22 and relays this data to the controller 30. If the temperature of the heating element 22 is low, the controller 30 sends a signal to the induction source 20 by way of the communication link 40. This signal causes the inductor 20 to continue to provide a magnetic field, thereby increasing the temperature in the element 22. If the temperature of the plate 22 rises above pre-determined level or temperature, the controller 30 can send by way of the communication link 40 a signal to the induction source 20. This signal causes a reduction in power of the magnetic flux produced by the induction source 20. This same signal can also be used to eliminate the presence of a magnetic flux by placing the induction source in an off mode of operation. By reducing the strength of the magnetic flux or eliminating the magnetic flux, the temperature of the heating element 22 can be reduced. Therefore, the feedback loop can control the temperature of the plate 22, thereby controlling the temperature within the housing 24.

In an alternate embodiment, the heating element 22 can be formed of a Curie point metal. By using a Curie point metal for the heating element 22, a communication link 40 and feedback loop between the temperature sensor 32 and the induction source 20 are not needed. Curie point metals have the property that they will heat only up to a certain temperature and not beyond.

The electronic circuit or controller 30 can have a backup or chargeable power supply which is charged by the power supply 42. The backup power supply can be a battery or can be a capacitor, for example. When the heating element 22 is placed near the induction source 20, the magnetic flux energizes the power supply 42, which can thereby provide energy to charge it.

Figure 4:
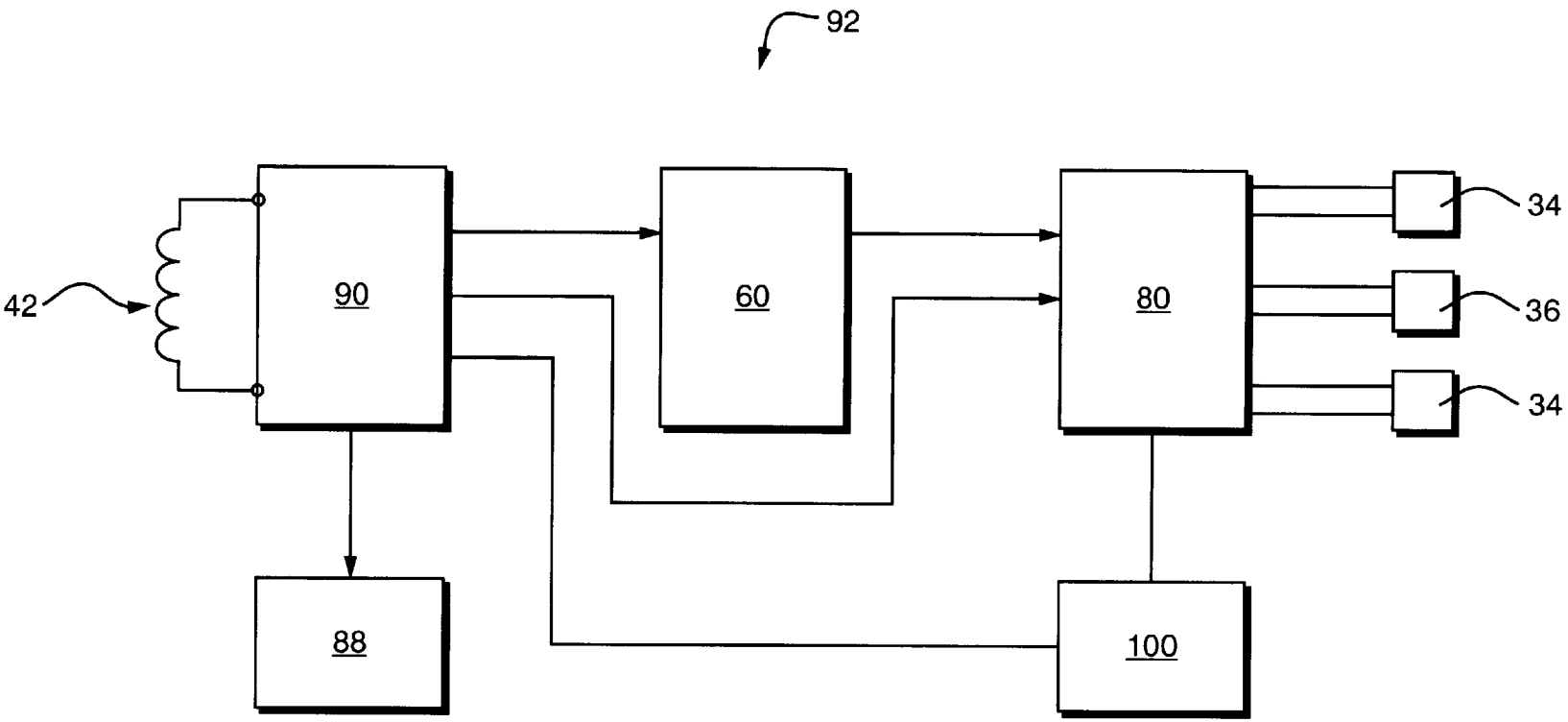
FIG. 4 shows a block diagram of a circuit for a controller.

FIG. 4 shows a block diagram of a circuit 92 for a controller 30. The controller circuit 92 can be connected to the power source 42. The controller circuit 92 includes a rectifier 90, a backup power supply 88 connected to the rectifier 90, a temperature sensor circuit 60, a temperature indicator circuit 80 and a blinker circuit 100. Temperature indicators 34 and a transmitting portion 36 of a communication link 40 are also connected to the circuit 92.

Figure 5:
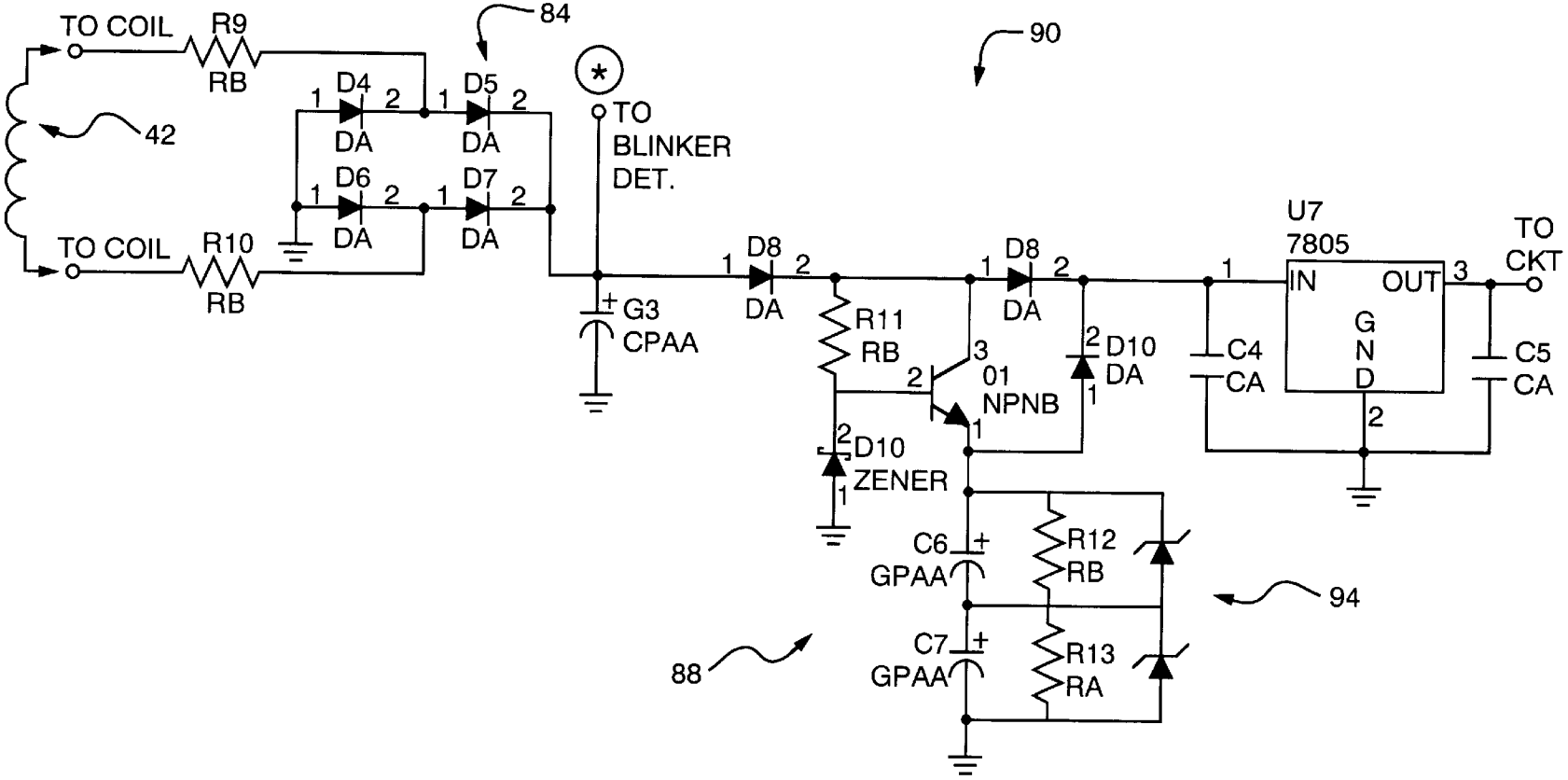
FIG. 5 illustrates a temperature controller circuit.

FIG. 5 illustrates the rectifier circuit 90 in more detail. It converts an AC input signal to a DC output signal and also charges the chargeable power source 88. The circuit includes input diode bridge 84 which acts to rectify the incoming signal. The chargeable power source 88 includes super capacitors in the illustrated embodiment. The circuit 90 can also include zener diodes 94 which regulate the output voltage, as well as a voltage regulator in circuit U7.

Figure 6:
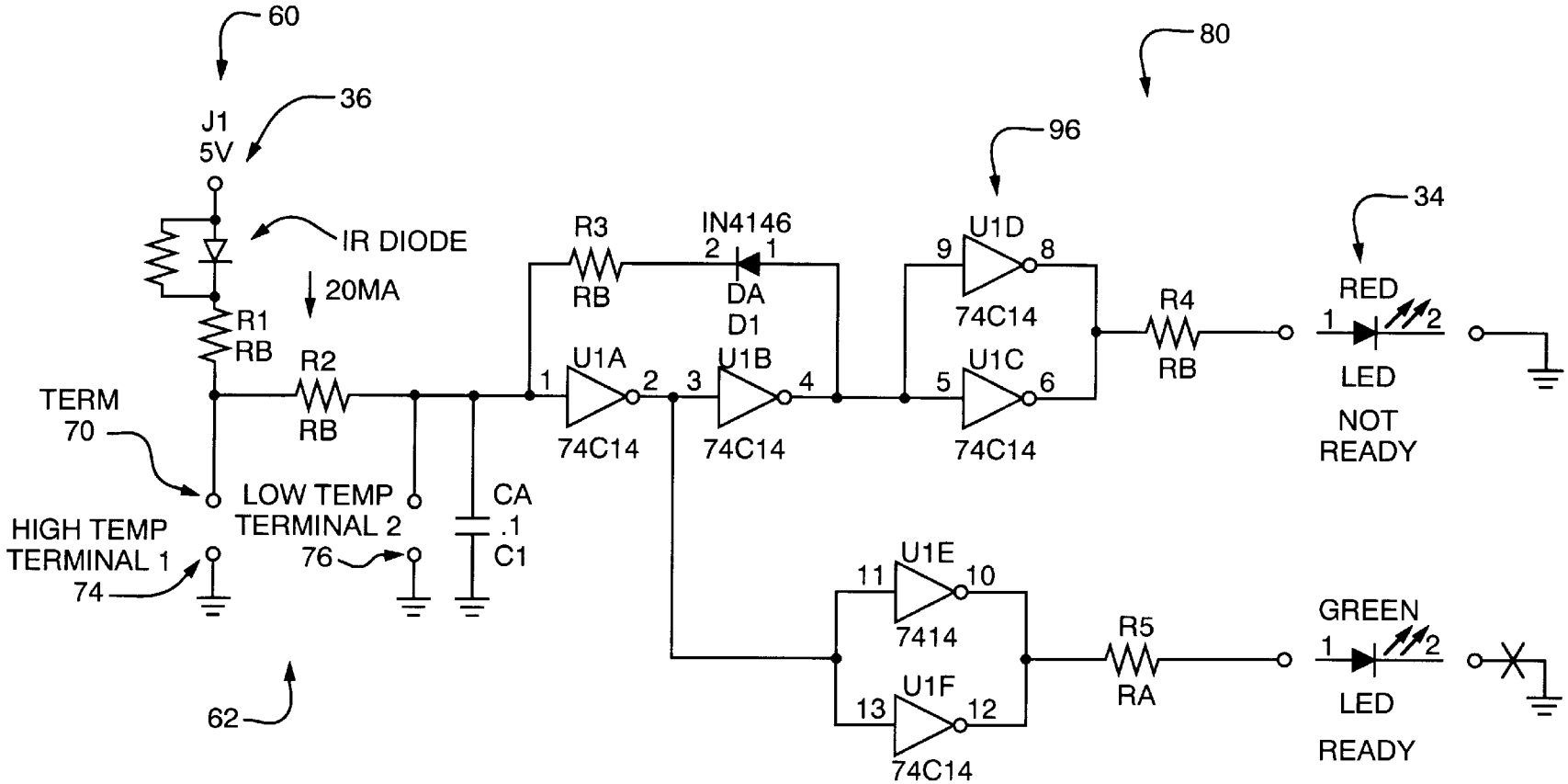
FIG. 6 illustrates a temperature indicator circuit.

FIG. 6 illustrates the temperature controller circuit 60 and the temperature indicator circuit 80. The temperature controller circuit 60 can include thermostats 62 and the transmitter 36, which is an infrared diode in the illustrated embodiment. The thermostats 62 include a first thermostat 74 and a second thermostat 76. The first thermostat 74 can be set so as to engage an off mode of operation when the temperature of the heating element 22 rises above a predetermined high temperature. When the temperature of the heating element 22 is below a pre-determined temperature, the first thermostat 74 is in a normally closed position. In this closed position, current flows through the IR diode, which in turn supplies light to the receiver 38 on the induction source 20. This signal indicates the need for a maintained or an increased magnetic flux strength. When the temperature of the heating element 22 rises above a preset temperature, the first thermostat 74 engages an open position, at which point the IR diode shuts off. This lack of signal causes the induction source to shut down, and prevents the heating element 22 from overheating.

The controller 30 can also include a temperature indicator circuit 80. The temperature indicator circuit 80 can include logic gates 96 and a visual temperature indicator 34. When the heating element 22 is in the process of being heated and is not at its desired, preset temperature level, the first thermostat 74 is in an open state. When the first thermostat 74 is in an open state, a current is provided which causes the indicator 34 to produce a "not ready" warning. For example, if the indicator 34 is a light emitting diode (LED), the current can excite the diode to produce a red color to indicate that the temperature of the heating element 22 is not at a desired level. When the heating element 22 has achieved its desired, preset temperature level, the thermostat 62 is caused to engage a closed state. When the first thermostat 74 is in a closed state, a current is provided to the indicator 34 which causes the indicator to produce a "ready" indication. For example, if the indicator is an LED, the current can excite the diode to produce a green color to indicate that the temperature of the heating element 22 is at a desired level.

The second thermostat 76 can be set so as to engage an off mode of operation when the temperature of the heating element 22 falls below a predetermined low temperature. During operation, the second thermostat 76 is normally in a closed position. When the temperature of the heating element 22 drops below the preset low temperature, the second thermostat 76 opens thereby providing a current to the indicator 34 to provide a "not ready" warning.

Figure 7:
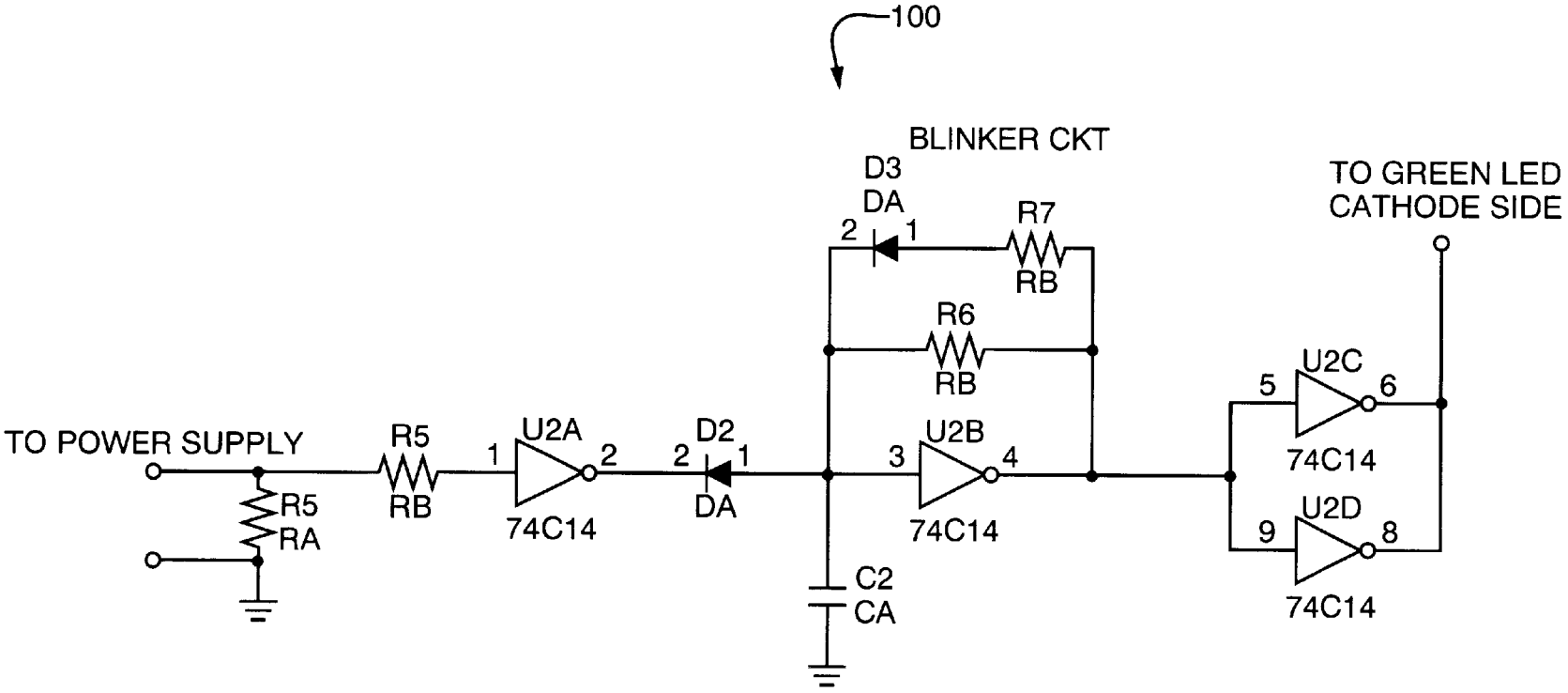
FIG. 7 shows a blinker circuit.

Another possible circuit is shown in FIG. 7. This is a circuit 100 which provides a blinking visual indication as long as the power supply 42 is connected. Such flashing or blinking can continue until the voltage source providing power to the circuit is terminated. For example, when the heating element 22 is removed from the induction source 20, the chargeable power supply 88 is used to power the blinker circuit 100. The LED 34 can flash until the power from the chargeable power source is drained. The chargeable power source can, for example, provide power to the circuit for approximately 30 minutes, thereby allowing flashing of the LED 34 for that amount of time. This time frame is the typically expected "hot" time for a pizza delivery.

Figure 8:
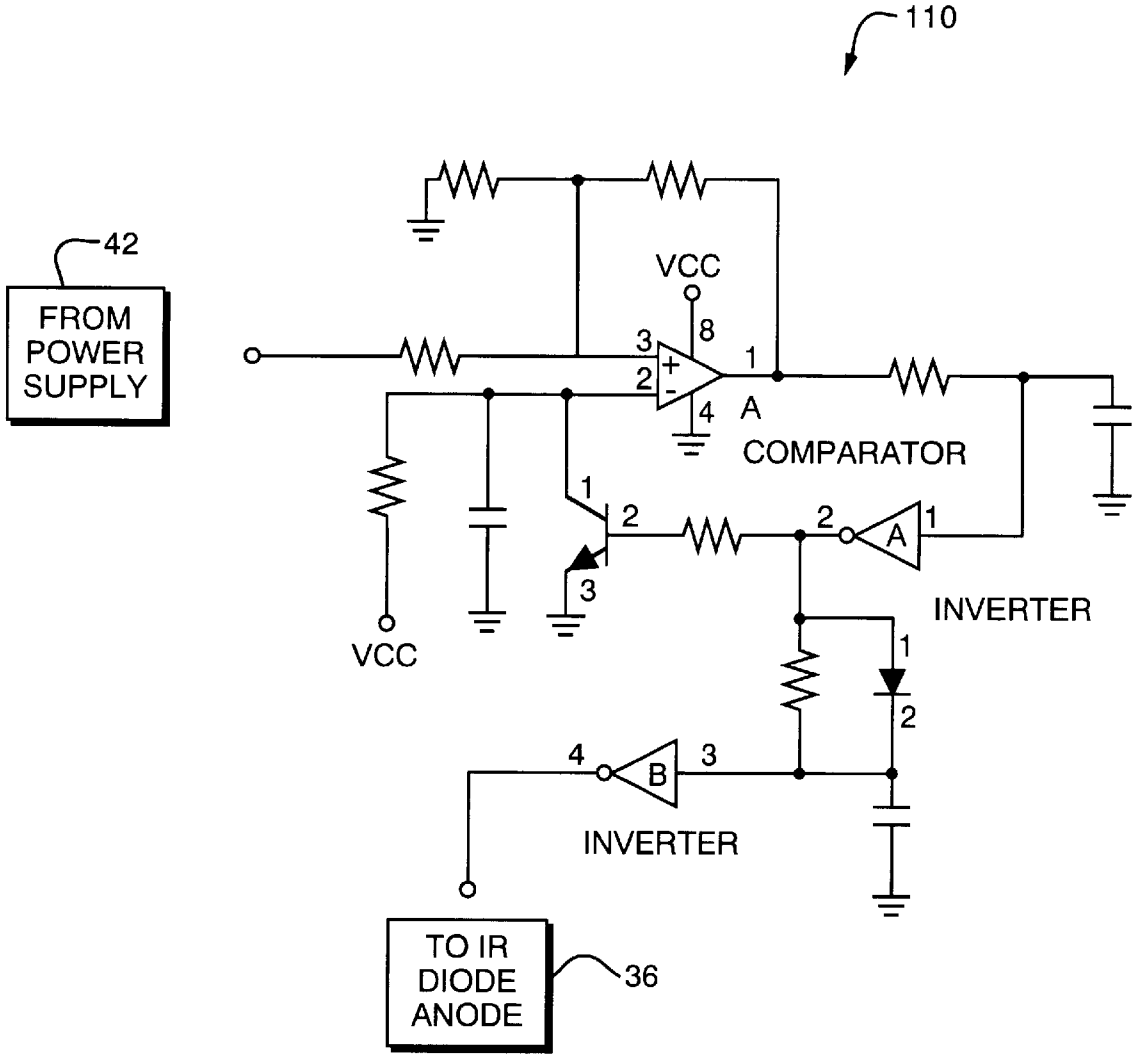
FIG. 8 illustrates a voltage controlled oscillation circuit.

FIG. 8 illustrates a voltage controlled oscillation circuit, given generally as 110. The circuit 110 creates a feedback loop between the power supply 42 and the induction source 20 based upon the voltage generated by the power supply 42. The voltage feedback loop can be used, for example, to increase the field strength from the induction source 20 if the power supply is improperly positioned over the source 20. The circuit 110 controls the transmitter 36, such as an infrared LED, such that the transmitter 36 flashes at a particular rate based upon the voltage produced by the power supply 42. For example, the closer the power supply 42 is to the induction source 20, the greater the voltage generated within the power supply.

With a relatively high voltage generated by the power supply 42, the circuit 110 sends a signal to the transmitter 36 which causes the transmitter 36 to flash at a relatively high rate. Conversely, with a relatively low voltage generated by the power supply 42, the circuit 110 sends a signal to the transmitter 36 which causes the transmitter 36 to flash at a relatively low rate. The signal sent by the transmitter 36 is received by the receiver 38 on the induction source 20.

The circuits shown here are by way of example only. Many other uses of the supply voltage generated by the supply 42 are possible. For example, the feedback loop formed between the power supply 42 and the induction source 20 could also include a microprocessor to control the loop. Such a microprocessor can be mounted to the housing 24 which holds the heating element 22 and power supply 42.

While this invention has been particularly shown and described with references to preferred embodiments thereof, it will be understood by those skilled in the art that various changes in form and details may be made therein without departing from the scope of the invention encompassed by the appended claims.

What is claimed is:

1. An induction heated container, comprising:

a housing;

a heating element mounted within the housing wherein the heating element is heated from an induction source;

a power supply energized by the induction source; and a circuit powered by the power supply, the circuit further comprising:

a backup power supply charged by the power supply.

2. The container of claim 1 wherein the power supply is energized by a magnetic field produced by the induction source.

3. The container of claim 1 wherein the circuit comprises a controller having a temperature sensor, a temperature indicator and a feedback loop formed between the temperature sensor and the induction source.

4. The container of claim 3 wherein the controller further comprises a communication link.

5. The container of claim 1 wherein the housing comprises a thermally insulated material.

6. The container of claim 1 wherein the power supply comprises an induction coil charged by the induction source.

7. The container of claim 1 wherein the circuit comprises a feedback loop formed between the power supply and the induction source.

8. The container of claim 7 wherein the feedback loop comprises a communications link between the power supply and the induction source.

9. The container of claim 1 wherein the backup power supply continues to power the circuit when the power supply is not energized by the induction source.

10. An induction heated container for holding items to be heated comprising:

a housing wherein the housing comprises a cavity, the cavity defined by a top surface, a bottom surface and a side wall, the side wall attaching an outer edge of the top surface with an outer edge of the bottom surface and wherein a portion of the side wall is moveably attached to the top surface and the bottom surface;

a heating element mounted within the housing, the heating element being heated from an induction source;

a power supply energized by the induction source; and a circuit energized by the power supply, the circuit further comprising:

a backup power supply charged by the power supply.

11. The container of claim 10 wherein the circuit comprises a controller having a temperature sensor for measuring a temperature of the heating element.

12. The container of claim 11 wherein the controller comprises a feedback loop formed between the temperature sensor and the induction source.

13. The container of claim 11 wherein the controller comprises a temperature indicator.

14. The container of claim 10 wherein the housing comprises thermally insulating material.

15. The container of claim 10 wherein the circuit comprises a feedback loop formed between the power supply and the induction source.

16. The container of claim 15 wherein the feedback loop comprises a communications link between the power supply and the induction source.

17. The container of claim 10 wherein the backup power supply continues to power the circuit when the power supply is not energized by the induction source.

18. A container for heating of food items comprising:

a housing;

a heating element mounted within the housing wherein the heating element is heated from an induction source;

a power supply energized by the induction source; and a circuit powered by the power supply, the circuit further comprising:

a backup power supply charged by the power supply.

19. The container of claim 18 wherein the power supply is energized by a magnetic field produced by the induction source.

20. The container of claim 18 wherein the power supply comprises an induction coil charged by the induction source.

21. The container of claim 18 wherein the power supply comprises an opening on the heating element, a first lead and a second lead wherein the opening creates a voltage differential transferred to the first lead and the second lead.

22. The container of claim 18 wherein the circuit comprises a feedback loop formed between the power supply and the induction source.

23. The container system of claim 22 wherein the feedback loop comprises a communication link between the power supply and the induction source.

24. The container system of claim 18 wherein the circuit comprises a controller having a temperature sensor for measuring a temperature of the heating element and a feedback loop formed between the temperature sensor and the induction source.

25. The container of claim 24 wherein the controller further comprises a temperature indicator.

26. The container of claim 24 wherein the feedback loop comprises a communication link between the induction source and the controller.

27. The container of claim 24 wherein the controller comprises the backup power supply, wherein the backup power supply is charged by a power supply.

28. The container of claim 18 wherein the backup power supply comprises a battery.

29. The container of claim 18 wherein the backup power supply comprises a capacitor.

30. The container of claim 18 wherein the housing is thermally insulated.

31. The container of claim 18 wherein the housing comprises a cavity, the cavity defined by a top surface, a bottom surface and a side wall, the side wall attaching an outer edge of the top surface with an outer edge of the bottom surface and wherein a portion of the side wall is moveably attached to the top surface and the bottom surface.

32. The container of claim 18 wherein the heating element is formed of a Curie point metal.

33. The container of claim 18 wherein the induction source comprises a ferrite material.

34. A container for heating food items, comprising:

a housing;

a heating element mounted within the housing, the heating element being driven by an induction source;

an induction-driven power supply energized by the induction source; and a circuit powered by the induction-driven power supply, the circuit further comprising:

a backup power supply charged by the induction-driven power supply, the backup power supply continuing to power the circuit when the induction-driven power supply is not energized by the induction source.

35. A container for heating food items, comprising:

a housing wherein the housing comprises a cavity, the cavity defined by a top surface, a bottom surface and a side wall, the side wall attaching an outer edge of the top surface with an outer edge of the bottom surface and wherein a portion of the side wall is moveably attached to the top surface and the bottom surface;

a heating element mounted within the housing, the heating element being driven by an induction source;

an induction-driven power supply energized by the induction source; and a circuit energized by the induction-driven power supply, the circuit further comprising:

a backup power supply charged by the induction-driven power supply, the backup power supply continuing to power the circuit when the induction-driven power supply is not energized by the induction source.

* * * * *